US005569055A

United States Patent [19]

Yamanashi et al.

[11] Patent Number: 5,569,055

[45] Date of Patent: Oct. 29, 1996

[54] CONNECTOR

[75] Inventors: Makoto Yamanashi; Keishi Jinno; Tamio Watanabe; Takayoshi Endo; Sakai Yagi, all of Shizuoka, Japan

[73] Assignee: Yazaki Corporation, Tokyo, Japan

[21] Appl. No.: 478,835

[22] Filed: Jun. 7, 1995

Related U.S. Application Data

[60] Division of Ser. No. 162,754, Dec. 7, 1993, Pat. No. 5,439,397, which is a continuation-in-part of Ser. No. 974,153, Nov. 10, 1992, abandoned, which is a division of Ser. No. 767,947, Sep. 30, 1991, Pat. No. 5,183,418.

[30] Foreign Application Priority Data

Oct. 1, 1990 [JP] Japan ..... 2-260629
May 27, 1991 [JP] Japan ..... 3-37485

[51] Int. Cl.[6] ..... H01R 13/436

[52] U.S. Cl. ..... 439/752; 439/595

[58] Field of Search ..... 439/595, 752

[56] References Cited

U.S. PATENT DOCUMENTS

| | | | |
|---|---|---|---|
| 4,891,021 | 1/1990 | Hayes et al. | 439/752 |
| 4,921,448 | 5/1990 | Endo et al. | 439/595 |
| 4,984,998 | 1/1991 | Duncan et al. | 439/752 |
| 5,037,336 | 8/1991 | Betsui | 439/752 |
| 5,057,042 | 10/1991 | Yamanashi et al. | 439/752 |
| 5,059,142 | 10/1991 | Ohta et al. | 439/752 |
| 5,061,210 | 10/1991 | Jinno | 439/752 |
| 5,066,253 | 11/1991 | Kameyama | 439/752 |
| 5,069,639 | 12/1991 | Kodama et al. | 439/752 |
| 5,071,373 | 12/1991 | Nagaska et al. | 439/752 |
| 5,071,374 | 12/1991 | Plocek et al. | 439/752 |
| 5,292,261 | 3/1994 | Hirano et al. | 439/752 |

FOREIGN PATENT DOCUMENTS

| | | | |
|---|---|---|---|
| 3839014 | 6/1990 | Germany | 439/752 |
| 50112888 | 9/1975 | Japan . | |
| 52120394 | 9/1977 | Japan . | |
| 5548638 | 3/1980 | Japan . | |
| 234083 | 3/1990 | Japan . | |
| 4141972 | 5/1992 | Japan . | |
| 5217621 | 8/1993 | Japan | 439/752 |

*Primary Examiner*—Gary F. Paumen
*Attorney, Agent, or Firm*—Sughrue, Mion, Zinn, Macpeak & Seas

[57] ABSTRACT

A double-lock connector includes a connector housing having terminal receiving chambers, metal terminals for being inserted respectively into the terminal receiving chambers, and a terminal retainer connectable to a rear end portion of the connector housing in a two-stage manner, that is, in a provisionally-connected condition and a completely-connected condition, wherein even when the terminal retainer in the provisionally-connected condition, the metal terminal can be smoothly inserted into the connector housing. The double-lock connector of the present invention includes a connector housing and a terminal retainer for being inserted into the connector housing. The connector housing has a plurality of terminal receiving chambers which are separated from one another by a horizontal partition wall and a vertical partition wall. An elastic retaining piece is provided within each of the terminal receiving chambers. A rearwardly-extending tongue-like terminal guide piece is formed on the horizontal partition wall, separating the upper and lower terminal receiving chambers from each other, and is disposed centrally with the width of each terminal receiving chamber. A front end of the terminal guide piece is extended substantially to an inlet end of the connector housing.

2 Claims, 9 Drawing Sheets

CONNECTOR

This is a divisional of application No. 08/162,754, filed Dec. 7, 1993, now U.S. Pat. No. 5,439,397, which in turn is a continuation-in-part of application Ser. No. 07/974,153, filed Nov. 10, 1992, (Now Abandoned), which in turn is a divisional of Ser. No. 07/767,947, filed Sep. 30, 1991, now U.S. Pat. No. 5,183,418.

BACKGROUND OF THE INVENTION

1. Field of the invention

This invention relates to a connector for connecting, for instance, wire harnesses in a motor vehicle, and more particularly to an improvement of the connector to prevent metal terminals from being inserted into the terminal accommodating chambers of a connect:or housing inside out, and to prevent the unintentional removal of the metal terminals.

2. Related art

A conventional connector of this type is as shown in FIGS. 9 through 11. In these figures, reference character a designates a connector housing; b, a terminal locking member; and c, a metal terminal. The connector housing a has terminal accommodating chambers $a_1$, in each of which a first flexible locking piece $a_2$ is provided for the metal terminal c. As for each terminal accommodating chamber, the terminal locking member b has a pair of second flexible locking pieces $b_1$.

The terminal locking member b has temporary locking pieces $b_2$ with temporary locking protrusions $b_{2'}$, and a final locking piece $b_3$ with a final locking protrusion $b_{3'}$. These protrusions are engaged with the locking portions of locking frames $a_3$ formed in the connector housing a.

The metal terminal c comprises an electrical contact portion $c_1$, and a wire connecting portion $c_2$. The electrical contact portion has a bottom portion $c_3$ , and a pair of stabilizers $c_4$ extended downwardly from the bottom portion $c_3$ to regulate the posture of the metal terminal inserted into the terminal accommodating chamber $a_1$. The terminal hocking member b has insertion holes $b_5$ formed in its main frame $b_4$. Passage guide protrusions $b_6$ having smooth guide surfaces $b_{6'}$, which are for instance arcuate in correspondence to the configuration of the bottom portion $c_3$, are formed in the insertion holes $b_5$ of the terminal locking member b. Passage permitting grooves $b_7$ are formed beside the passage guide protrusions $b_6$ in correspondence to the stabilizers $c_4$ of the metal terminals c.

With the temporary locking protrusions $b_{2'}$ temporarily engaged with the locking portions of the locking frame $a_3$, the metal terminal c is inserted into the terminal accommodating chamber $a_1$ through the insertion hole $b_5$ in the main frame $b_4$ of the terminal locking member b. In this operation, the bottom portion $c_3$ abuts against the passage guide protrusions $b_6$; however, it goes over the passage guide protrusions readily because the latter have the smooth guide surfaces $b_{6'}$, while the stabilizers $c_4$ are moved along the passage permitting grooves $b_7$. Thus, the metal terminal can be smoothly inserted into the terminal accommodating chamber $a_1$.

If the metal terminal is held inside out by error when inserted, then the stabilizers $c_4$ are caused to collide against the upper portion of the main frame $b_4$, thus preventing the difficulty that the metal terminal is inserted inside out.

The size of the insertion hole $b_5$ depends on that of the wire connection portion $c_2$. Therefore, in the case where the wire connecting portion is increased in dimension, it is necessary to increase the amount of protrusion of the stabilizers $c_4$.

In the above-described conventional connector, the stabilizers greatly protruded from the metal terminal are utilized to eliminate the difficulty that the metal terminal is inserted inside out. For instance when the metal terminal is connected to a wire, the stabilizers thus formed may damage the wire by scratching it.

In order to lock the metal terminal into the terminal accommodating chamber of the connector housing, in general a flexible locking arm is provided on the inner wall of the terminal accommodating chamber. That is, when the metal terminal is inserted into the terminal accommodating chamber, the flexible locking arm thus provided is engaged with the metal terminal so as to prevent the difficulty that the metal terminal is unintentionally removed. Recently, a connector has been proposed in the art in which a terminal locking member is provided behind the connector housing which, together with or instead of the flexible locking arm, acts to positively eliminate the difficulty that the metal terminal is unintentionally removed from the connector (cf. Japanese Utility Patent Application (OPI) No. 34083/1990 (the term "OPI" as used herein means an "unexamined published application").

FIG. 12 shows another example of the conventional connector, which comprises a connector housing a", and a terminal locking member b". In FIG. 12, the terminal locking member b" is temporarily engaged with the connector housing a" (the locking mechanisms of the connector housing and the terminal locking members being not shown).

The connector housing a" has a plurality of terminal accommodating chambers c". Each of the terminal accommodating chambers c" has a flexible locking piece e" for a metal terminal d" in correspondence to the respective terminal accommodating chamber c", and a terminal retaining piece e" which is inserted into the respective terminal accommodating chamber c".

The connector thus constructed is used as follows: That is, with the terminal locking member b" temporarily engaged with the connector housing a", the metal terminal d" is inserted into the terminal accommodating chamber c" through the insertion hole f". In this operation, as shown in the upper half of FIG. 13, the metal terminal d" is inserted while flexing the terminal retaining piece g" which is on its way, and then deflecting the flexible locking piece e". When the metal terminal has been fully inserted, the flexible locking piece e" is restored to lock the metal terminal d". Thereafter, the terminal locking member b" is inserted into the connector housing a"; that is, the terminal locking member b" is completely engaged with the connector housing a". As a result, the terminal retaining piece g" also locks the metal terminal d", thus preventing the unintentional removal of the metal terminal d".

The connector thus constructed is disadvantageous in the following point. As shown in FIG. 12, a gap m is provided between the terminal locking member b" and the partition wall h" between the upper and lower terminal accommodating chambers c" and c". Therefore, if the metal terminal d" is slightly inclined as shown in the lower half of FIG. 13 when inserted, then the end $d"_1$ will strike against the rear end $h"_1$ of the partition wall h", thus obstructing the smooth insertion of the metal terminal.

If a metal terminal d is inserted obliquely in a horizontal direction as shown in FIG. 14, an end edge d1 of the metal terminal d impinges on a rear edge i' of a partition wall i separating right and left terminal receiving chambers c of a connector housing a, so that the insertion of the metal terminal d can not be carried out smoothly.

SUMMARY OF THE INVENTION

In view of the foregoing, an object of this invention is to provide a connector in which the difficulty that the metal terminal is inserted inside out is prevented without provision of large protrusions such as stabilizers.

Another object of the invention is to provide a connector in which, even when the terminal locking member is temporarily engaged with the connector housing, the metal terminal can be smoothly inserted into the connector housing.

With the above problem in view, it is another object of this invention to provide a double-lock connector of the type in which in a provisionally-connected condition, even if a metal terminal is inserted into a connector housing slightly obliquely in a vertical direction or in a horizontal direction, the metal terminal can be smoothly inserted.

The foregoing objects and other objects of the invention have been achieved by the provision of the following connectors:

An example of a connector provided according to the invention comprises: a connector housing including terminal accommodating chambers each of which has a first flexible locking piece for locking a metal terminal; and a terminal locking member which is movably engaged with the connector housing in two steps, temporarily and finally, and which has second flexible locking pieces provided for locking the metal terminals in the terminal accommodating chambers, respectively. Each of the second flexible locking pieces has a locking protrusion at the free end which, when the metal terminal is inserted inside out, is engaged with an inverted-insertion preventing protrusion formed on the metal terminal, or each of the second flexible locking pieces is adapted to push, when the metal terminal is inserted inside out, the metal terminal against the wall of the terminal accommodating chamber, to cause the end portion of the metal terminal to abut against a locking step formed on the wall of the terminal accommodating chamber.

Another example of the connector according to the invention comprises: a connector housing having terminal accommodating chambers; metal terminals which are to be inserted into said terminal accommodating chambers; and a terminal locking member which is engaged with said connector housing in two steps, temporarily and finally. The connector housing includes terminal guide pieces formed on a partition wall which divides the terminal accommodating chambers into upper and lower terminal accommodating chambers, and the terminal guide pieces are adapted to guide metal terminals into the terminal accommodating chambers, respectively.

Further, another example of the connector of the present invention comprises a connector housing having terminal receiving chambers; metal terminals for being inserted into the terminal receiving chambers, respectively; and a terminal retainer connectable to a rear portion of the connector housing in a two-stage manner, that is, in a provisionally-connected condition and a completely-connected condition; wherein a notch is formed in a partition wall of the connector housing separating the terminal receiving chambers; a partition wall of the terminal retainer separating terminal receiving chambers of the terminal retainer is extended in a terminal-inserting direction so as to be disposed adjacent to the notch of the connector housing; and in the provisionally-connected condition, the extension portion guides the metal terminal into the terminal receiving chamber of the connector housing.

The terminal guide piece is formed on the partition wall of the connector housing separating the upper and lower terminal receiving chambers from each other, and in the provisionally-connected condition, the terminal guide piece guides the metal terminal into the terminal receiving chamber. Therefore, even if the metal terminal is tilted slightly in a vertical direction when the metal terminal is to be inserted into the terminal receiving chamber, the metal terminal can be smoothly inserted thanks to the terminal guide piece.

The notch is formed in the partition wall of the connector housing separating the terminal receiving chambers, and the partition wall of the terminal retainer separating the terminal receiving chambers of the terminal retainer is extended in the terminal-inserting direction so as to be disposed adjacent to the notch of the connector housing. With this construction, even if the metal terminal is tilted slightly in a horizontal direction when the metal terminal is to be inserted into the terminal receiving chamber in the provisionally-connected condition, the extension portion of the partition wall of the terminal retainer guides the front end of the metal terminal, so that the metal terminal can be smoothly inserted.

The nature, principle and utility of the invention will become more apparent from the following detailed description when read in conjunction with the accompanying drawings.

DETAILED DESCRIPTION OF THE INVENTION

Preferred embodiments of this invention will be described with reference to the accompanying drawings.

Figure 1:
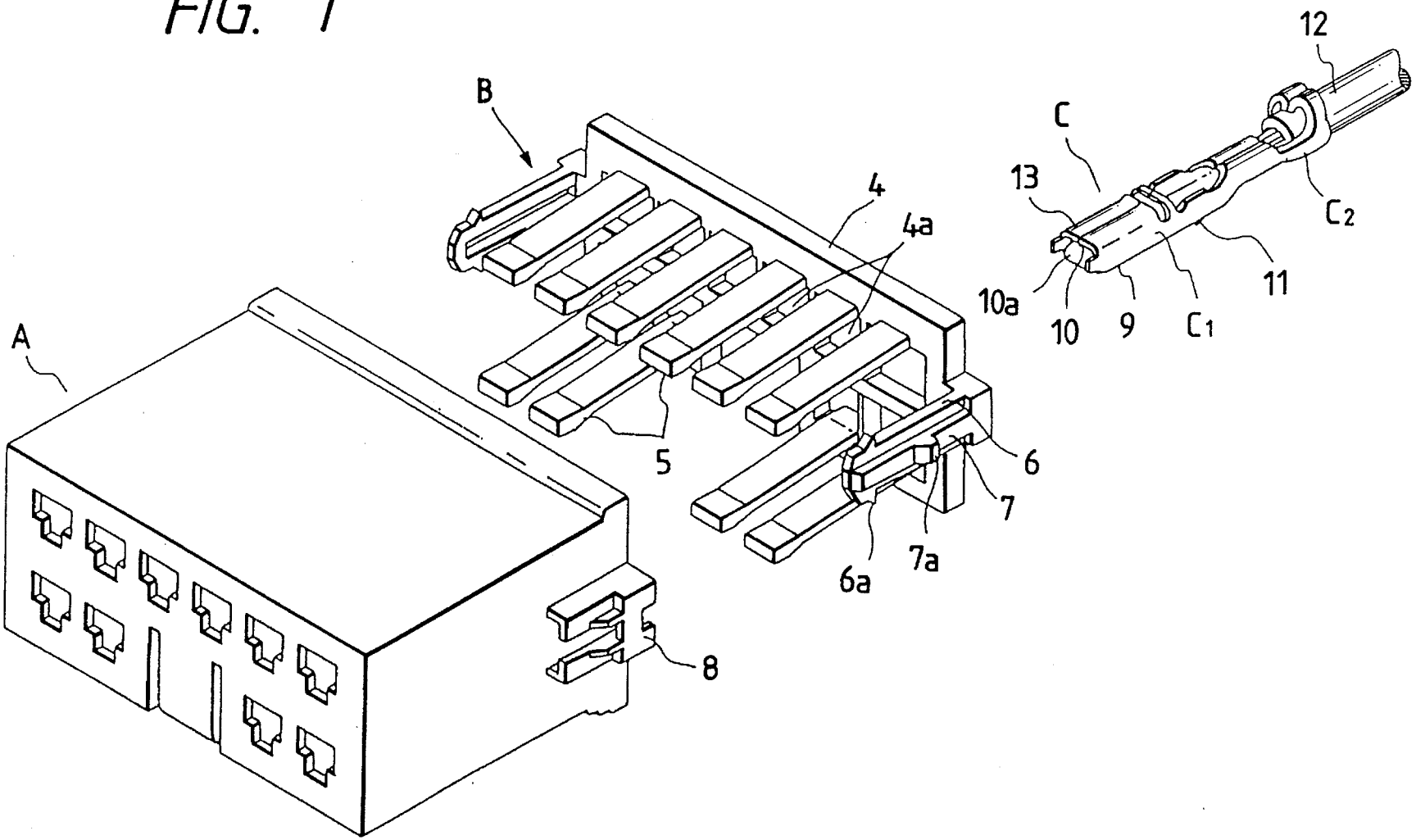
FIG. 1 is an exploded perspective view showing an example of a connector, which constitutes a first embodiment of this invention.
Figure 2:
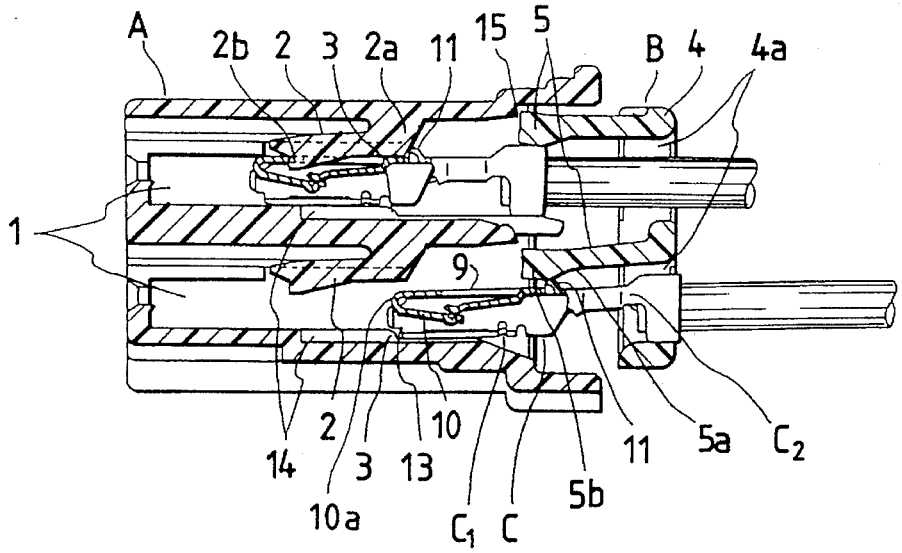
FIG. 2 is a sectional view showing a terminal locking member temporarily engaged with a connector housing in the connector shown in FIG. 1.

An example of a connector, a first embodiment of this invention, is as shown in FIGS. 1 and 2. In FIGS. 1 and 2, reference character A designates a connector housing; B, a terminal locking member; and C, a metal terminal.

The connector housing A has a plurality of terminal accommodating chambers 1. In each of the terminal accommodating chambers 1, a first flexible locking piece 2 is extended forwardly from its one inner wall, and a locking step 3 is formed on the other inner wall opposite to the one inner wall. The base end portion of the first flexible locking piece 2 is formed into a rising base portion 2*a* which is joined to the inner wall, and the front end portion is formed into a locking portion 2*b* which is engaged with the metal terminal C.

The terminal locking member B comprises: a main frame 4 with insertion holes 4*a* in correspondence to the terminal accommodating chambers 1; and second flexible locking pieces 5 extended forwardly from the main frame 4. Each of the flexible locking pieces 5 includes a tapered guide portion 5*a* and a swelled end portion 5*b*.

Two temporary locking pieces 6 each having a temporary locking protrusion 6*a*, and two final locking pieces 7 each having a final locking protrusion 7*a* are provided on both sides of the main frame 4 of the terminal locking member B. These locking pieces 6 and 7 are engaged with locking portions in locking frames 8 formed on the connector housing A.

The metal terminal C comprises an electrical contact portion $C_1$ and a wire connecting portion $C_2$. The electrical contact portion $C_1$ is made up of a bottom portion 9, an arcuately bent portion 10*a* extended from the bottom portion 9, and an elastic contact piece 10 extended from the arcuately bent portions 10*a*. The electrical contact portion further comprises a protrusion 11 extended at the rear end of the bottom portion 9. The protrusion 11 is to prevent the metal terminal from being inserted inside out by error (hereinafter referred to as "an inverted insertion preventing protrusion 11", when applicable).

Under the condition that the terminal locking member B is temporarily engaged with the connector housing A (as shown in FIG. 2), the metal terminal C connected to a wire 12 is inserted into the terminal accommodating chamber 1 through the insertion hole 4*a* of the main frame 4. If, in this operation, the metal terminal C is held inside out, then as shown in the lower half of FIG. 2 the electrical contact portion $C_1$ is pushed downwardly in the terminal accommodating chamber 1 by the swelled end portion 5*b* of the second flexible locking piece 5, so that the front end 13 of the electrical contact portion $C_1$ is abutted against the locking step 3; that is, the difficulty is eliminated that the metal terminal is inserted inside out.

In the case where the metal terminal is correctly inserted, the electrical contact portion $C_1$ is moved into the terminal accommodating chamber 1 going over the locking step 3 readily because the elastic contact piece 10 has the arcuately bent portion 10*a* at the end.

In the case where the locking step 3 is broken by an external force, as shown in the upper half of FIG. 2 the inverted-insertion preventing protrusion 11 of the metal terminal C is caused to strike against the rising base portion 2*a* of the first flexible locking piece, thus preventing the metal terminal from being inserted inside out.

In this operation, the swelled end portion 5*b* of the flexible locking piece 5 of the terminal locking member 5 is caused to ride on the metal terminal C; that is, it does not lock the latter C; however, the swelled end portion 5*b* is confronted with the step 15 of the connector housing A, thus preventing the terminal locking member B from being finally engaged with the connector housing A.

Figure 3:
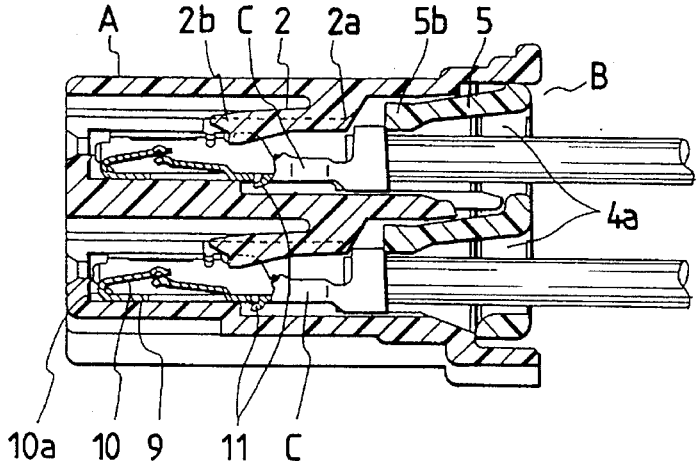
FIG. 3 is a sectional view showing the terminal locking member completely engaged with the connector housing in the connector.

In the case where the metal terminal C is inserted correctly, the inverted-insertion preventing protrusion 11 is engaged with a groove 14 formed in the terminal accommodating chamber 1, so that the locking portion 2*b* of the first flexible locking piece 2 is engaged with the rear end of the electrical contact portion $C_1$, thus preventing the metal terminal C from being unintentionally removed from the connector housing. Under this condition, the terminal locking member B is pushed so as to be finally engaged with the connector housing. As a result, the swelled end portion 5*b* of the second flexible locking piece 5 is engaged with the rear end of the wire connecting portion $C_2$, thus additionally locking the metal terminal C, as shown in FIG. 3.

Figure 4:
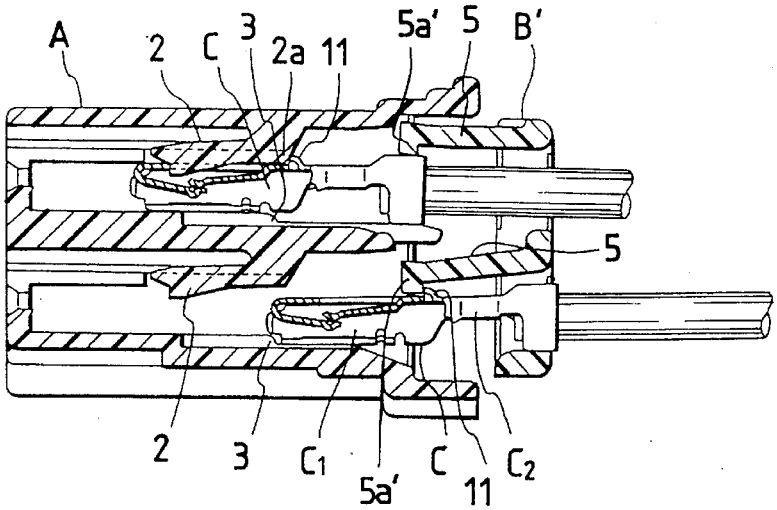
FIG. 4 is a sectional view showing one modification of the connector.

FIG. 4 shows one modification of the connector described above. In the modification, the end portion of a second flexible locking piece 5 of a terminal locking member B' is formed into a locking protrusion 5*a*'. In the case where the metal terminal C is inserted inside out as shown in the lower half of FIG. 4, the inverted-insertion preventing protrusion 11 of the electrical contact portion $C_1$ of the metal terminal C is engaged with the engaging protrusion 5*a*', thus preventing the further insertion of the metal terminal C.

Furthermore, similarly as in the above-described first embodiment, both the locking step 3 and the rising base portion 1*a* prevent the metal terminal from being inserted inside out.

As was described above, the connector of the invention comprises: the connector housing including the terminal accommodating chambers each of which has the first flexible locking piece for the respective metal terminal; and the terminal locking member which is temporarily engaged with the connector housing and then completely engaged with the connector housing, and which has the second flexible locking pieces provided for locking the metal terminals in the terminal accommodating chambers, respectively. The free end portion of each of the second flexible locking pieces is formed into the locking protrusion which is engaged with the inverted-insertion preventing protrusion of the metal terminal. The second flexible locking piece pushes the metal terminal against the wall of the terminal accommodating chamber, to cause the end portion of the metal terminal to abut against the locking step of the wall of the terminal accommodating chamber. Owing to this structure, it is unnecessary to prevent the metal terminal from being inserted inside out at the insertion hole of the terminal locking member; that is, the internal construction of the connector effectively eliminates the difficulty that the metal terminal is inserted inside out.

Another example of the connector, a second embodiment of the invention, will be described with reference to FIGS. 5 through 8.

Figure 5:
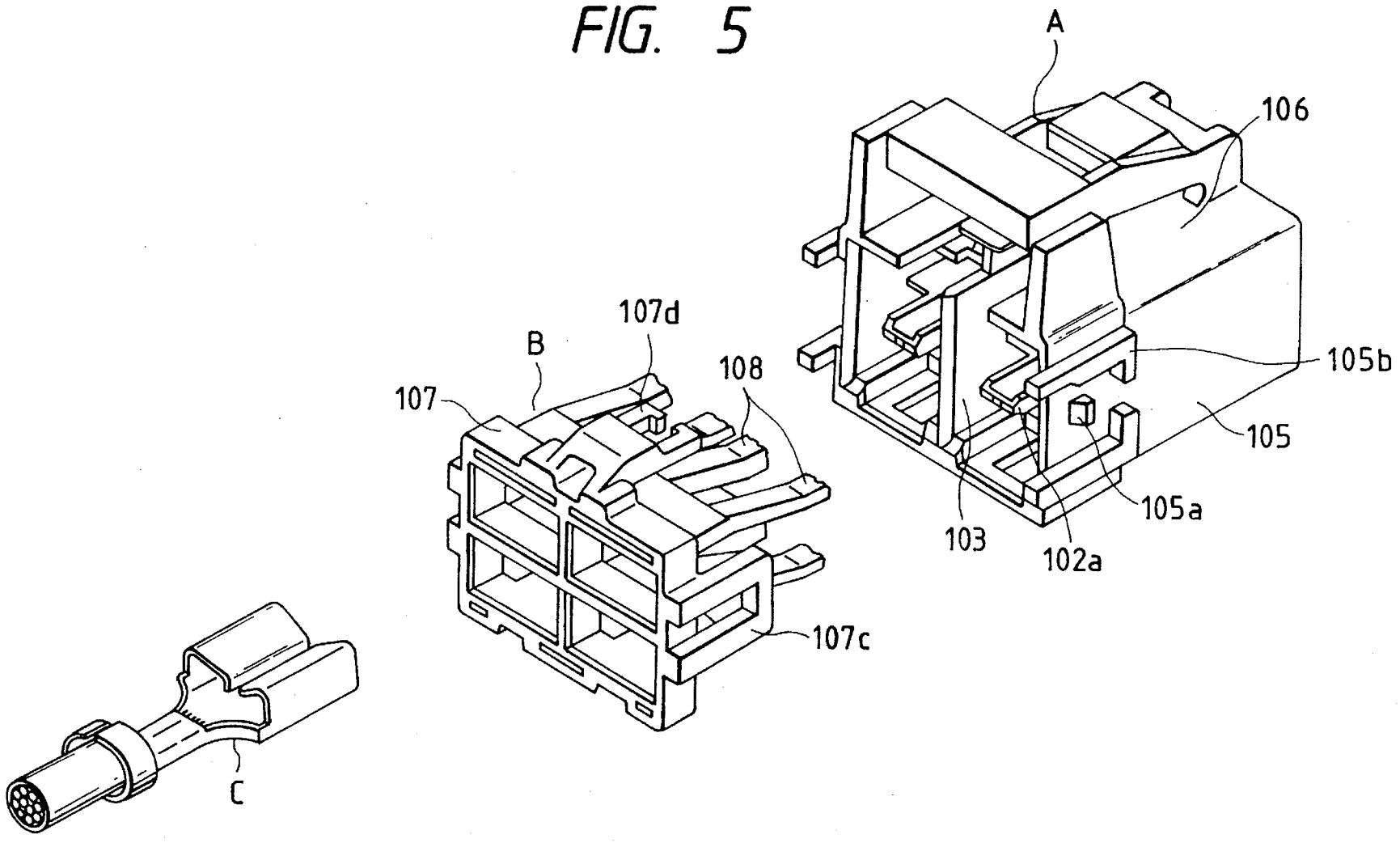
FIG. 5 is an exploded perspective view showing another example of the connector, which constitutes a second embodiment of the invention.

In FIG. 5, reference character A designates a connector housing made of synthetic resin; B, a terminal locking member of synthetic resin; and C, a metal terminal connected to an electrical wire.

Figure 6:
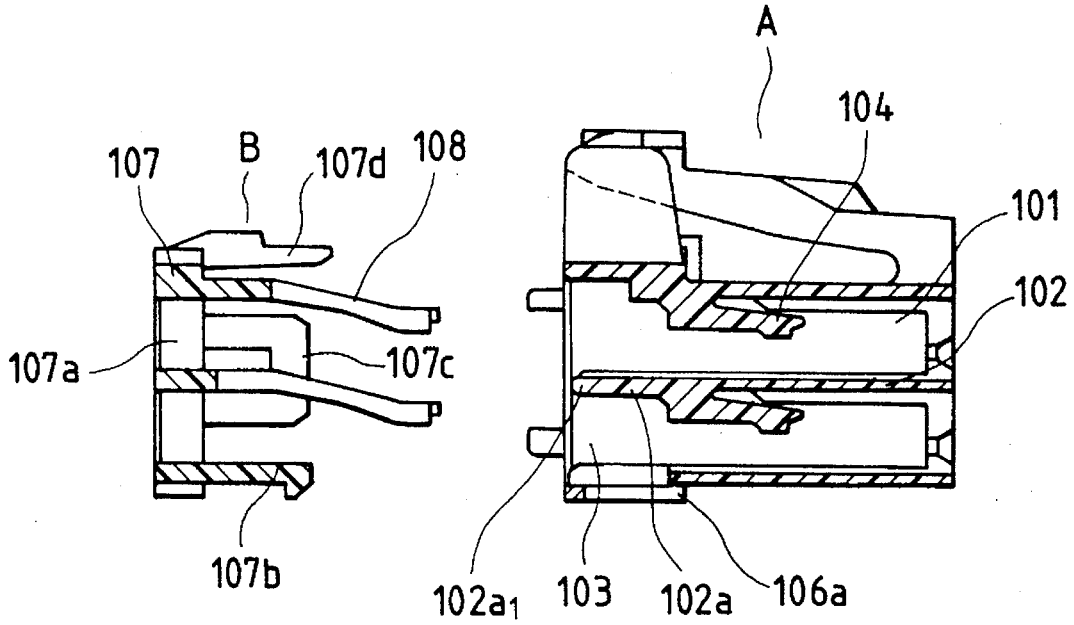
FIG. 6 is a longitudinal sectional view of a connector housing and a terminal locking member in the connector shown in FIG. 5.

The connector housing includes a plurality of terminal accommodating chambers 101 which are defined by a horizontal partition wall 102 and a vertical partition wall 103. Each of the terminal accommodating chambers 102 has a flexible locking piece 104. The connector housing A has two side walls, on each of which a final engaging protrusion 105*a* and a final engaging frame 105*b* are provided. As shown in FIG. 6, a tongue-shaped terminal guide piece 102*a* is formed on the horizontal partition wall 102 at the middle which separates the upper and lower terminal accommodating chambers in such a manner that it is extended axially. More specifically, the end $\mathbf{102}a_1$ of the terminal guide piece 102*a* is substantially at the inlet of the connector housing A. The connector housing A has upper and lower walls 106. A temporary engaging hole 106*a* is formed in the lower wall 106*a* of the connector housing A.

The terminal locking member B has a frame 107, which includes a plurality of insertion holes 107*a* in correspondence to the above-described terminal accommodating chambers 101. The terminal locking member B has flexible terminal retaining pieces 108 on one side of the insertion holes 107*a*. A temporary locking piece 107*b* is formed on the lower wall of the frame 107. The temporary locking piece 107*b* and the abovedescribed temporary engaging hole 106*a* of the connector housing A form locking means. A final locking piece 107*c* is formed on each of the outer surfaces of two side walls of the frame 107. The final locking pieces 107*c* and the above-described final engaging protrusions 105*a* of the connector housing A form locking means. Another final locking piece 107*d* is formed on the outer surface of the upper wall of the frame 107. The final locking piece 107*d* and a final locking pawl (not shown) formed on the upper wall of the connector housing A form locking means.

Figure 7:
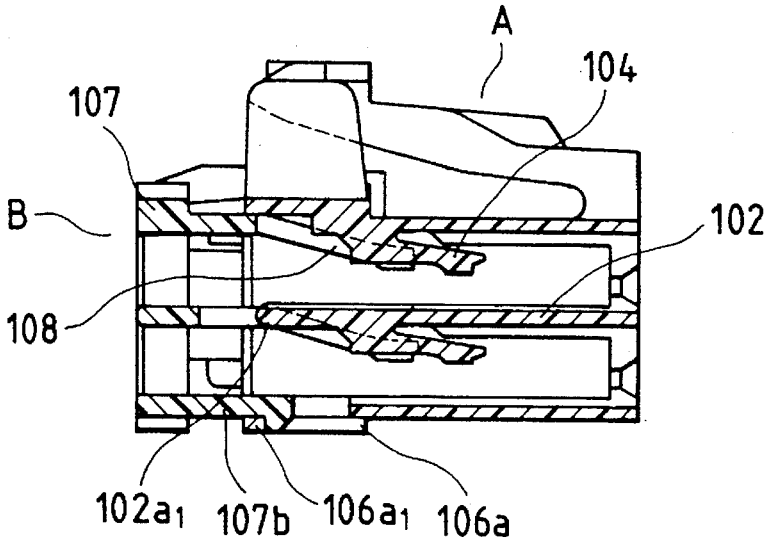
FIG. 7 is also a longitudinal sectional view showing the terminal locking member temporarily engaged with the connector housing.
Figure 8:
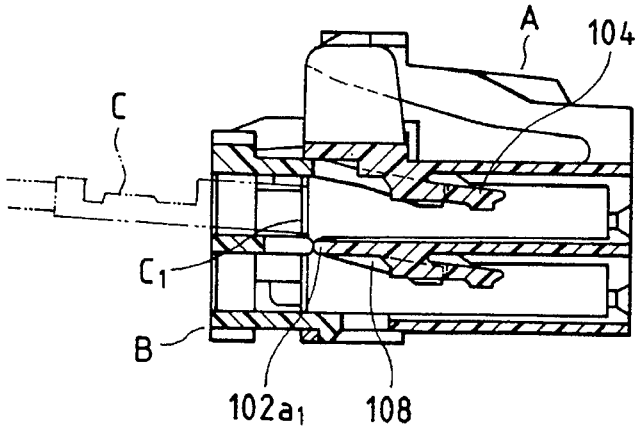
FIG. 8 is also a longitudinal sectional view showing the insertion of a metal terminal with the terminal locking member temporarily engaged with the connector housing as shown in FIG. 7.
Figure 9:
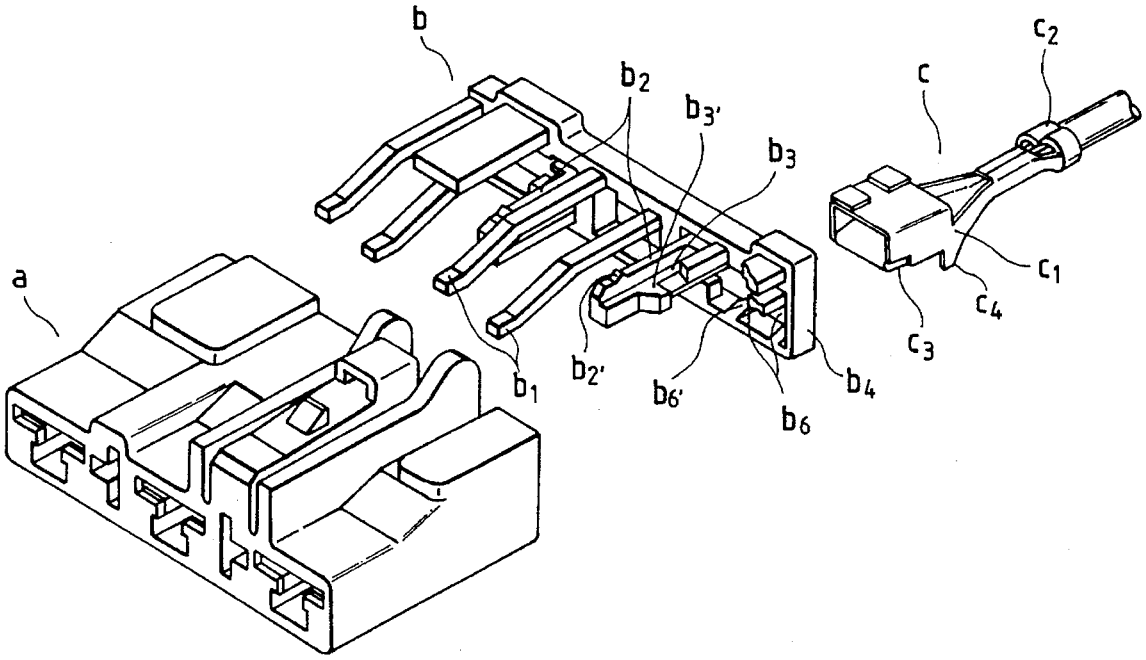
FIG. 9 is an exploded perspective view showing an example of a conventional connector.
Figure 10:
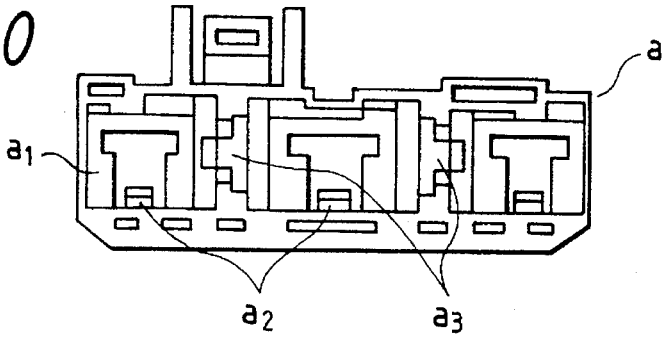
FIG. 10 is a rear view of a connector housing in the conventional connector.
Figure 11:
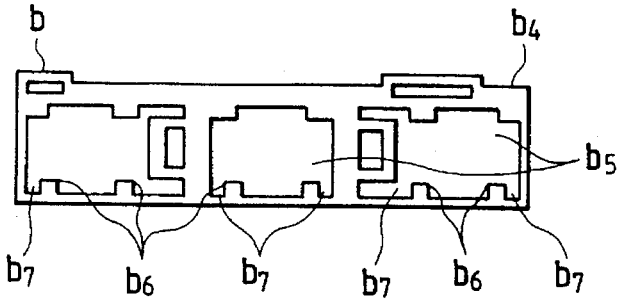
FIG. 11 is a rear view of a terminal locking member in the conventional connector.
Figure 12:
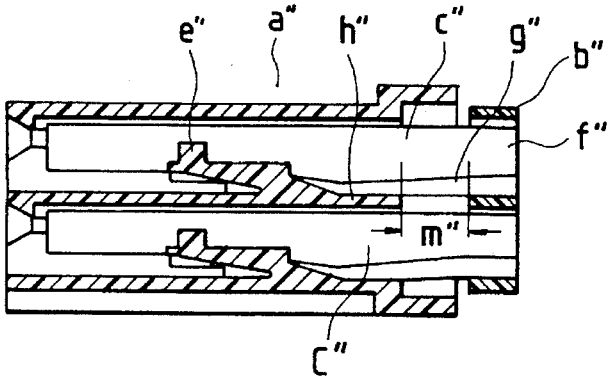
FIG. 12 is a longitudinal sectional view showing the terminal locking member temporarily engaged with the connector housing in the conventional connector.
Figure 13:
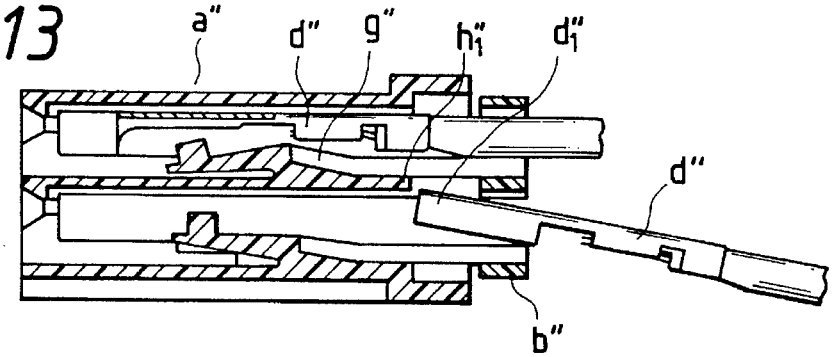
FIG. 13 is a longitudinal section view showing the insertion of a metal terminal with the terminal locking member temporarily engaged with the connector housing as shown in FIG. 12.
Figure 14:
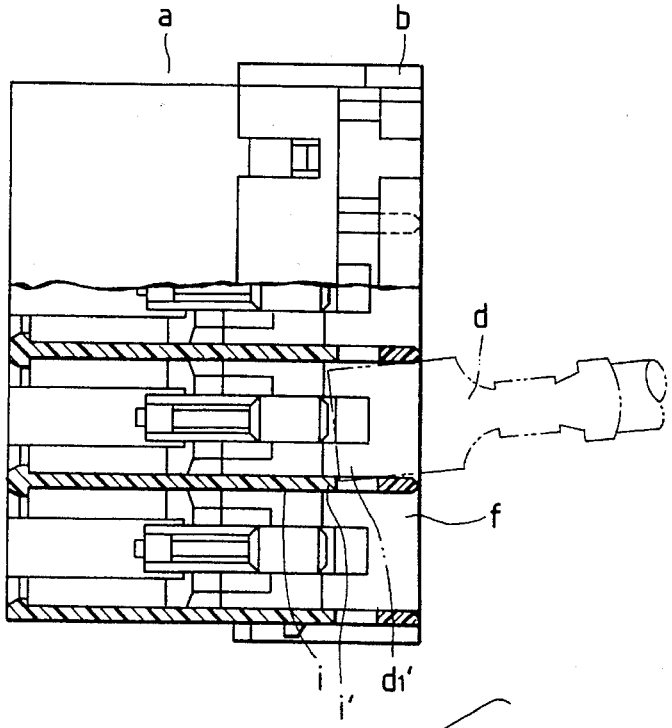
FIG. 14 is a plan view showing the insertion of the metal terminal with the terminal locking member temporaily engaged with the connector housing as shown in FIG. 12.

The connector housing A and the terminal locking member B manufactured separately are combined as follows: That is, as shown in FIG. 7, the terminal locking member B is temporarily engaged with the connector housing A. In this operation, the temporary locking piece 107*b* is engaged with the temporary engaging hole 106*a* formed in the lower wall of the connector housing A, thus being temporarily locked to the edge $\mathbf{106}a_1$ of the temporary engaging hole 106*a*.

Under this condition, the metal terminal C is inserted into the connector. Even if the metal terminal C is held slightly inclined, the end portion $C_1$ of the metal terminal C is smoothly inserted into the terminal accommodating chamber 101 being guided by the end $\mathbf{102}a_1$ of the terminal guide piece 102*a*. When the metal terminal has been inserted into the terminal accommodating chamber, the terminal locking member B is pushed into the connector housing, until the former is completely combined with the latter.

As was described above, the connector, the second embodiment of the invention, is made up of the connector housing with the terminal accommodating chambers, and the terminal locking member having the terminal retaining pieces which are inserted into the terminal accommodating chambers. The terminal locking member is engaged with the rear end portions of the connector housing in two steps, temporarily and finally. The terminal guide pieces are formed on the horizontal partition walls defining the upper and lower terminal accommodating chambers in such a manner that the terminal guide pieces are extended axially. When the terminal locking member is temporarily engaged with the connector housing, each terminal guide piece acts to guide the metal terminal into the terminal accommodating chamber, and therefore the metal terminal can be smoothly inserted into the terminal accommodating chamber in the connector housing.

While there has been described in connection with the preferred embodiments of the invention, it will be obvious to those skilled in the art that various changes and modifications may be made therein without departing from the invention, and it is aimed, therefore, to cover in the appended claims all such changes and modifications as fall within the true spirit and scope of the invention.

Another example of the connector, a third embodiment of the invention, will be described with reference to FIGS. 15 through 19.

Figure 15:
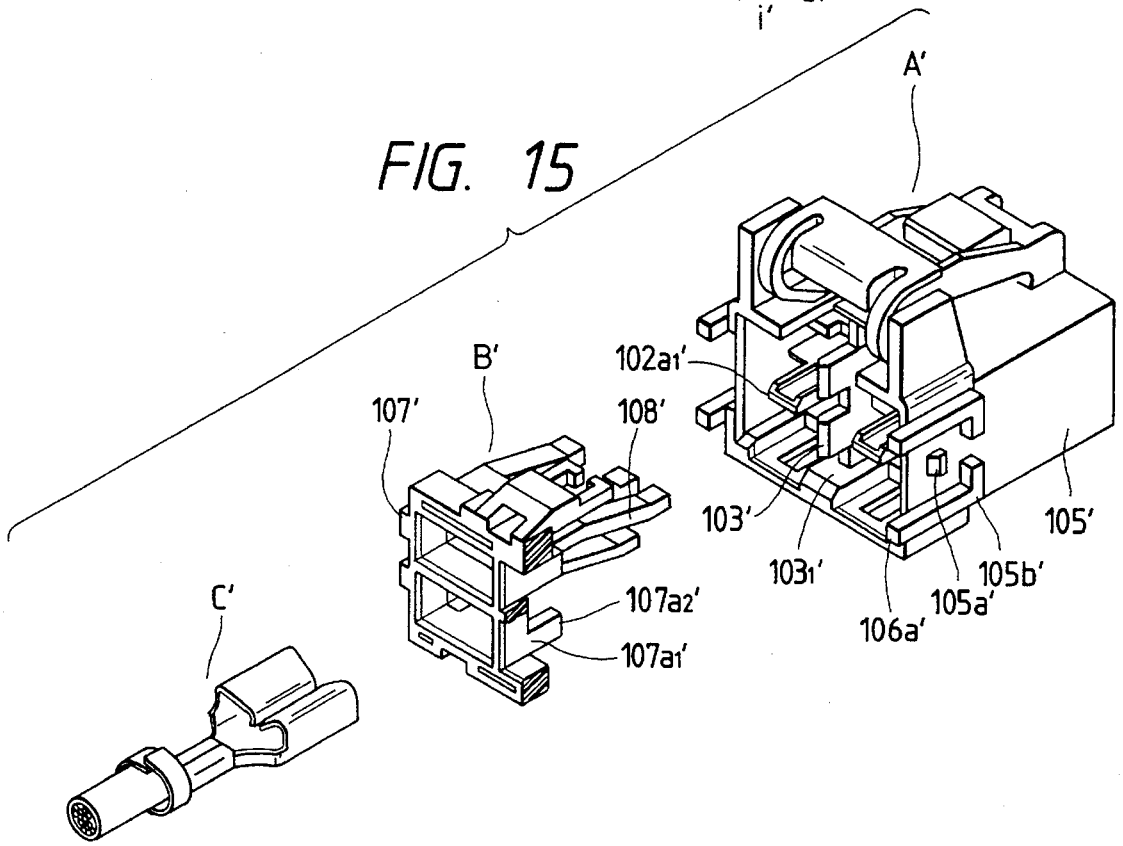
FIG. 15 is an exploded, perspective view of a third embodiment of the invention.
Figure 16A:
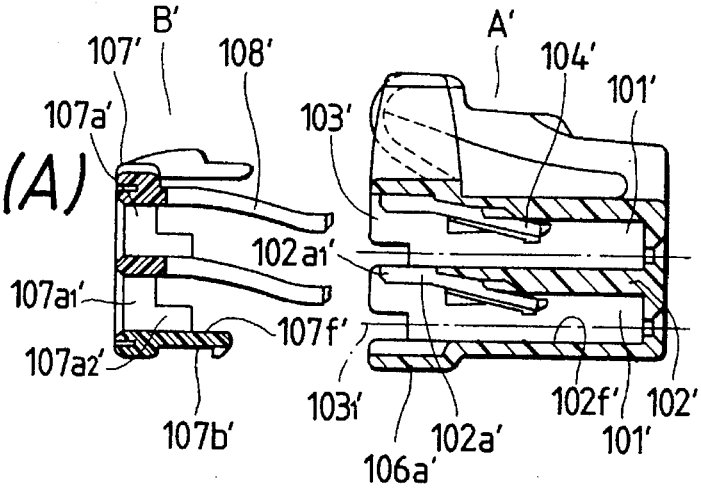
FIG. 16(A) is a vertical cross-sectional view of this embodiment.
Figure 16B:
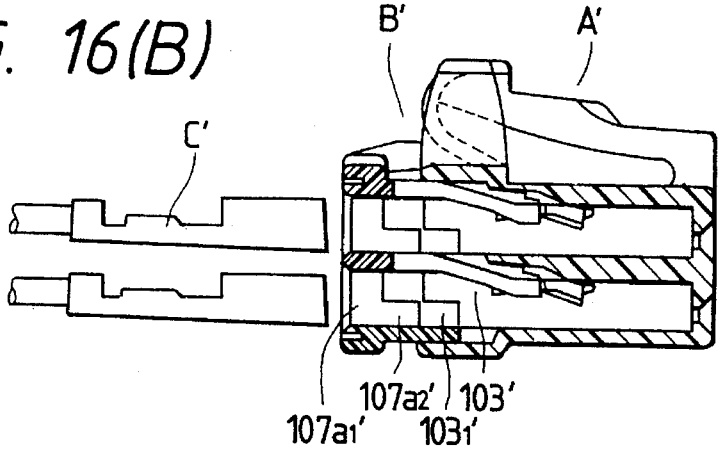
FIG. 16(B) is a vertical cross-sectional view of this embodiment in a provisionally-connected condition.
Figure 17:
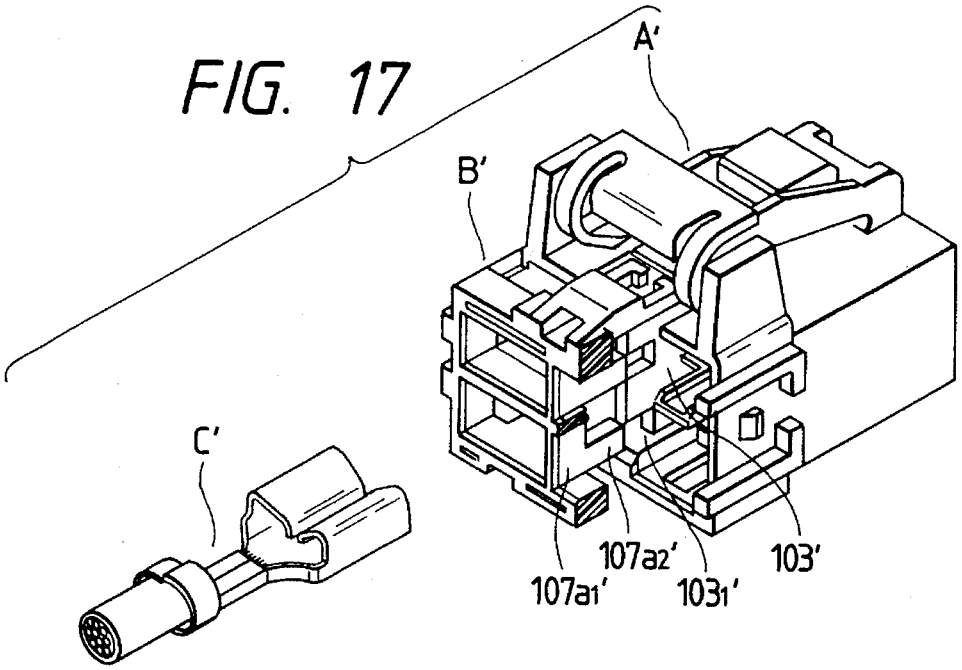
FIG. 17 is a partly-broken, exploded perspective view of this embodiment in the provisionally-connected condition.

FIG. 15 is an exploded, perspective view of the third embodiment of the present invention. FIG. 16(A) is a vertical cross-sectional view of this embodiment. FIG. 16(B) is a vertical cross-sectional view showing a condition in which a terminal retainer B' is provisionally connected to a connector housing A'. FIG. 17 is a partly-broken, exploded perspective view showing a condition in which the terminal retainer B' is provisionally connected to the connector housing A'.

In FIG. 15, each of the connector housing A' and the terminal retainer B' is integrally molded of a synthetic resin material. Reference character C' denotes a metal terminal connected to an electric wire.

The connector housing A' has a plurality of terminal receiving chambers 101', and the upper and lower terminal receiving chambers 101' are separated from each other by a horizontal partition wall 102', and the right and left terminal receiving chambers 101' are separated from each other by a vertical partition wall 103'. An elastic retaining piece 104' is provided within each of the terminal receiving chambers 101'. A complete-connection projection 105*a*' and a complete-connection abutment frame 105*b*' are formed on an outer surface of each of opposite side walls 105'.

In FIG. 16(A), a rearwardly-extending tongue-like terminal guide piece 102*a*' is formed on the horizontal partition wall 102' separating the upper and lower terminal receiving chambers 101' from each other, and is disposed centrally of the width of each terminal receiving chamber. A front end 102*a*1' of this guide piece is extended generally to an end of an inlet of the connector housing A'. A notch $\mathbf{103}_1$' is formed in a lower portion of an inlet edge or end of the vertical partition wall 103' separating the right and left terminal receiving chambers 101' from each other.

The terminal retainer B' includes a frame 107' having a plurality of insertion holes **107*a*' corresponding respectively to the terminal receiving chambers 101'. An elastic terminal holder piece 108' is projected from one side of the insertion hole 107*a*', and a provisional-connection retaining piece 107*b*' is formed on a lower surface of the frame 107'. This retaining piece cooperates with the provisional-connection hole 106*a*' in the connector housing A' to form a retaining means. Complete-connection retaining pieces (not shown in FIG. 16 (A)) are formed on outer surfaces of opposite side walls of the frame 107', respectively, and cooperate with the complete-connection projections 105*a*' of the connector housing A' to form a retaining means. A vertical partition wall 107*a*1', separating the right and left insertion holes 107*a*' from each other, is extended at a lower portion of its front end to form an extension portion 107*a*2' which snugly fits in the notch $\mathbf{103}_1$' when the terminal retainer B' is completely connected to the connector housing A'. When the terminal retainer B' is provisionally connected to the connector housing A', the front edge of the extension portion 107*a*2' lies substantially in a plane in which the inlet edge of the vertical partition wall 103' having the notch $\mathbf{103}_1$' lies (see FIG. 16**(B)).

The other construction is the same as that of the second embodiment, and explanation thereof is omitted.

Only those portions of the above construction of the third embodiment different from those of the second embodiment will now be described.

Figure 18:
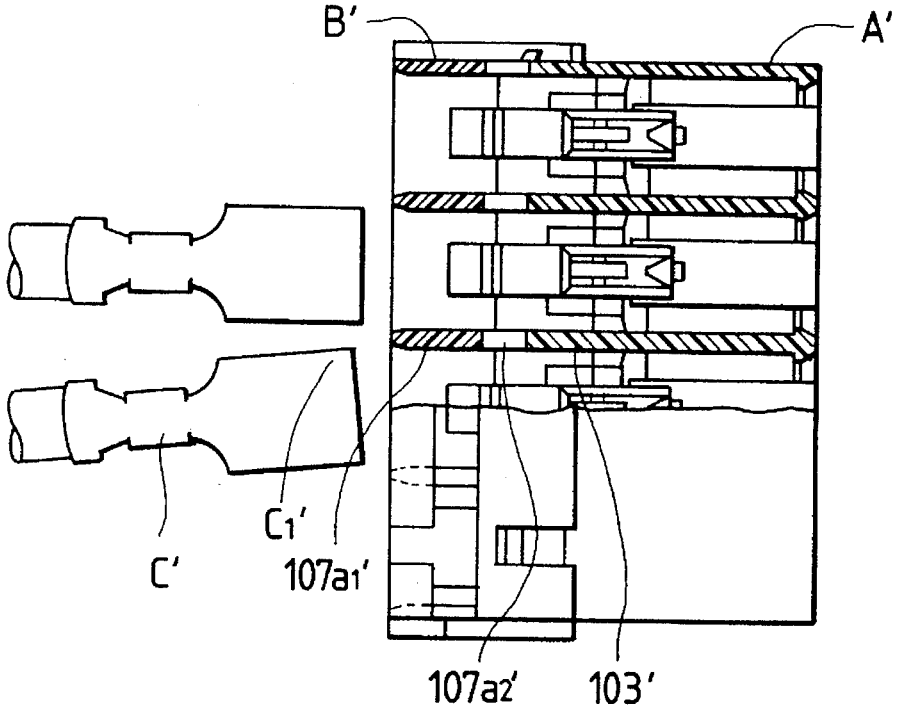
FIG. 18 is a plan view of this embodiment in the provisionally-connected condition.

The terminal retainer B' is provisionally connected to the connector housing A' as shown in FIG. 17, and in this condition the necessary metal terminals C' are passed through the respective insertion holes **107*a*' of the terminal retainer B', and are finally inserted into the respective terminal receiving chambers 101' of the connector housing A'. Even if the metal terminal C' is inserted in such a manner that it is slightly tilted in a horizontal direction as shown in FIG. 18, the left side portion of the front end C1' of the metal terminal C' first slides on the vertical partition wall 107*a*1' of the terminal retainer B', and then slides on the extension portion 107a2' of the vertical partition wall 107*a*1'. After this front end slides past the extension portion 107*a*2', it slides on the inlet end portion of the vertical partition wall 103' of the connector housing A' disposed immediately adjacent thereto, and finally slides into the terminal receiving chamber 101'** of the connector housing A'.

Namely, even if the metal terminal C' is inserted obliquely in the horizontal direction, it can be smoothly inserted.

More specifically, when the terminal is to be inserted into the connector housing A' with the terminal being tilted in vertical or horizontal direction in the provisional condition, the terminal lock member B' and the connector housing are in the following conditions.

(1) When the terminal is tilted upwardly:

The terminal passes through an opening at a rear end of the terminal retainer B', and then is smoothly inserted along a lower surface of an arm portion of an upper flexible terminal retaining pieces 108'.

(2) In FIG. 16 (B), the terminal is tilted downwardly:

(a) The terminal, which is positioned at an upper terminal receiving chamber 101', passes through the opening at the rear end of the terminal lock member B', and then advances along a horizontal portion of an lower flexible terminal retaining pieces 108', and further advances along an upper surface of the horizontal partition wail 102' with a projection 102a1' at the rear end thereof.

Figure 19A:
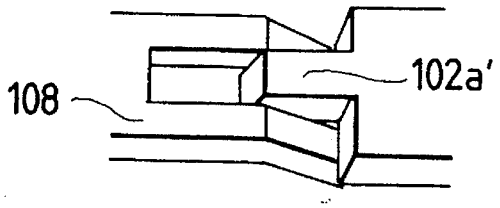
FIG. 19 (*a*) and (*b*) are exploded plan and side views of this embodiement in the provisionally-connected condition.
Figure 19B:
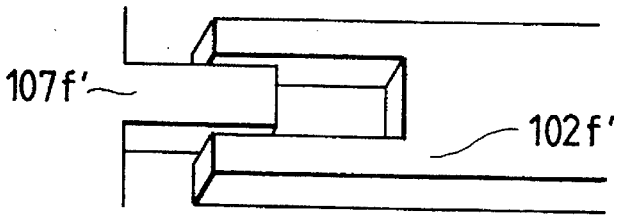

A front end of the horizontal portion of an lower flexible terminal retaining pieces 108' is recessed, and the rearwardly-extending tongue-like terminal guide piece **102*a*' includes projection 102*a*1' and therefore the insertion of the terminal can be carried out smoothly from the terminal lock member to connector housing A' (FIG. 19**(*a*). The width of the projection is smaller than the width of the terminal.

(b) The terminal, which is positioned at a lower terminal receiving chamber 101', passes through the opening at the rear end of the terminal retainer B', and the advances along a horizontal partition wall of the frame 107' and further advances along a lower horizontal surface of a lower receiving chamber 101' of the terminal housing A'.

A front end of a lower portion **107*f* of the terminal lock member B' constitutes a projection, and the rear end of the lower horizontal wall 102*f* of the lower terminal accommodating chamber is recessed for receiving projection 107*f* (FIG. 19**(*b*)), and therefore the insertion of the terminal can be carried out smoothly from the terminal retainer B' to the terminal housing A'. The front end portion of the lower portion **107*f* of the terminal retainer B' partially overlaps with the rear end of the lower horizontal wall 102*f* of the lower terminal accommodating chamber 101'**. The width of the projection is smaller than the width of the terminal.

(3) As shown in FIG. 18, when the terminal is tilted in right and left directions:

The terminal passes through the opening at the rear end of the terminal lock member B', and then advances along a side wall surface of the connector housing A', and further advances along a vertical partition wall 103', so that the terminal is smoothly inserted. The extension portion **107*a*2' is accommodated in the inlet edge of the vertical partition wall 103' in the completely-connected condition. The dimension of the projection 107*a*2'** in the direction of the height is smaller than that of the terminal.

As described above, the construction of the third embodiment of the present invention comprises the connecter housing having the terminal receiving chambers, and the terminal retainer which includes the terminal holder pieces insertable into the respective terminal receiving chambers, and is connectable to the rear portion of the connector housing in a two-stage manner, that is, in the provisionally-connected condition and the completely-connected condition, wherein the rearwardly-extending terminal guide pieces are formed on the horizontal partition wall of the connector housing separating the upper and lower terminal receiving chambers from each other, and in the provisionally-connected condition, each of the terminal guide pieces guides the metal terminal into the corresponding terminal receiving chamber. With this construction, in the provisionally-connected condition, even if the metal terminal is inserted slightly obliquely into the terminal receiving chamber, it can be smoothly inserted.

The notch is formed in the partition wall of the connector housing separating the terminal receiving chambers; the partition wall of the terminal retainer separating the right and left terminal receiving chambers of said terminal retainer from each other is extended in the terminal-inserting direction. With this construction, even if the metal terminal is slightly tilted when the metal terminal is to be inserted into the terminal receiving chamber in the provisionally-connected condition, the extension portion of the partition wall of the terminal retainer guides the front end of the metal terminal, so that the metal terminal can be smoothly inserted.

What is claimed is:

1. A double locked connector comprising:

a connector housing having terminal receiving chambers for respectively receiving terminals, at least a bottom horizontal wall of said connector housing, which partially defines at least one of said chambers, having a first front inside surface and a second rear inside surface which is recessed with respect to said first inside surface, said connector housing including retaining arms for respectively retaining said terminals;

a terminal retainer connectable to a rear portion of said connector housing in a provisionally-connected condition and a completely-connected condition, said terminal retainer including terminal retaining means extending in a forward direction toward said connector housing so as to be received in said terminal receiving chambers to respectively retain said terminals when said terminal retainer is in said completely-connected condition; and terminal guide means for guiding the metal terminals into the respective terminal receiving chambers in the provisionally-connected condition, the terminal guide means being provided with the connector housing and the terminal retainer, wherein the terminal guide means includes:

a projection being independent of said terminal retaining means and extending forwardly from the terminal retainer in opposition to an associated one of said terminal retaining means; and a recess portion defined by said second inside surface in which said projection of the terminal retainer is received when said terminal retainer is in the provisionally-connected condition such that an upper surface of said projection is substantially coplanar with said first inside surface of said bottom wall, to thereby smoothly guide an associated terminal into the associated terminal receiving chamber when the terminal is upwardly or downwardly tilted.

2. A double-locked connector as claimed in claim 1, wherein a width of the projection is not more than a width of the associated terminal.

* * * * *